US011815104B2

(12) United States Patent
Fan et al.

(10) Patent No.: US 11,815,104 B2
(45) Date of Patent: Nov. 14, 2023

(54) INTEGRATED WATER-COOLING PUMP

(71) Applicant: Huizhou Xunshuo Technology Co., Ltd, Huizhou (CN)

(72) Inventors: Ganglong Fan, Taiwan (CN); Zhihui Chen, Huizhou (CN)

(73) Assignee: Huizhou Xunshuo Technology Co., Ltd, Huizhou (CN)

( * ) Notice: Subject to any disclaimer, the term of this patent is extended or adjusted under 35 U.S.C. 154(b) by 0 days.

(21) Appl. No.: 18/301,941

(22) Filed: Apr. 17, 2023

(65) Prior Publication Data

US 2023/0250834 A1 Aug. 10, 2023

(30) Foreign Application Priority Data

Jan. 9, 2023 (CN) ..... 202320077891.5

(51) Int. Cl.

| | |
|---|---|
| ***F04D 29/42*** | (2006.01) |
| ***F04D 13/06*** | (2006.01) |
| ***F04D 1/00*** | (2006.01) |
| ***F04D 29/00*** | (2006.01) |

(52) U.S. Cl.

CPC ..... *F04D 29/4293* (2013.01); *F04D 1/00* (2013.01); *F04D 13/06* (2013.01); *F04D 29/007* (2013.01)

(58) Field of Classification Search

CPC ..... F04D 29/4293; F04D 1/00; F04D 13/06; F04D 29/007

See application file for complete search history.

(56) References Cited

U.S. PATENT DOCUMENTS

| | | | | |
|---|---|---|---|---|
| 6,263,957 | B1 * | 7/2001 | Chen | H01L 23/473 174/15.1 |
| 8,245,764 | B2 * | 8/2012 | Eriksen | F04D 15/0066 165/80.4 |
| 10,609,841 | B2 | 3/2020 | Xiao | |
| 11,297,735 | B2 * | 4/2022 | Lai | F28D 1/04 |
| 11,445,634 | B2 * | 9/2022 | Yoon | F04D 13/06 |

FOREIGN PATENT DOCUMENTS

| | | | |
|---|---|---|---|
| CN | 101228495 | B | 3/2013 |

* cited by examiner

*Primary Examiner* — Mary Davis

(57) ABSTRACT

An integrated water-cooling pump includes a main body, which includes a water block, a bottom plate, a water inlet, a water outlet, a cavity, a first inlet pipe, a fixed plate, a water nozzle, and a first sealing ring. The bottom plate is welded to a bottom of the water block. The bottom plate has an internal hollow structure. A bottom of an inner wall of the bottom plate is fixedly connected with heat sinks. An upper surface of the bottom plate is symmetrically provided with two water inlets. A middle of the upper surface of the bottom plate is provided with the water outlet. The water block is provided with the cavity inside near the bottom plate. The bottom plate is communicated with the cavity through two water inlets. The upper surface of the bottom plate is fixedly connected with a bottom of the first inlet pipe.

8 Claims, 5 Drawing Sheets

INTEGRATED WATER-COOLING PUMP

CROSS-REFERENCE TO RELATED APPLICATIONS

This application claims the benefit of priority from Chinese Patent Application No. 202320077891.5, filed on Jan. 9, 2023. The content of the aforementioned application, including any intervening amendments thereto, is incorporated herein by reference in its entirety.

TECHNICAL FIELD

This application relates to water cooling techniques, and more particularly to an integrated water-cooling pump.

BACKGROUND

The water-cooling system uses a pump to circulate the coolant in the heat-dispersing pipes for heat dissipation. A heat-absorbing part on a radiator is used to absorb heat from the computer's CPU, north bridge chipset, and graphics card. The heat absorbed by the heat-absorbing part is transported to outside of the computer through the radiator disposed on the back.

Two categories of water-cooling pumps (i.e., integrated water-cooling pump and split-type water-cooling pump) are commonly used in the practical operation. Due to the size limitation, the integrated water-cooling pumps are exterior to the split-type water cooling pumps in the heat dissipation performance. Therefore, the split-type water cooling pumps are preferred for the high-end water-cooling systems. However, due to the presence of leakage points between the split-type water cooling pump and the water block, a higher water leakage risk is brought. In case of water leakage, the motherboard and other components will be damaged. Thus, an improved integrated water-cooling pump is provided.

SUMMARY

In view of the deficiencies in the prior art, this application provides an integrated water-cooling pump.

Technical solutions of this application are described as follows.

In a first aspect, this application provides an integrated water-cooling pump, including:

a main body;

wherein the main body includes a water block, a bottom plate, two water inlets, a water outlet, a cavity, a first inlet pipe, a fixed plate, a water nozzle, and two first sealing rings;

the bottom plate is weldedly connected to a bottom of the water block; the bottom plate has an internal hollow structure; a bottom of an inner wall of the bottom plate is fixedly connected with a heat sink; the two water inlets are symmetrically provided on two sides of an upper surface of the bottom plate; the water outlet is provided at a middle of the upper surface of the bottom plate; the cavity is provided at a side in the water block close to the bottom plate; the bottom plate is communicated with the cavity through the two water inlets; and the upper surface of the bottom plate is fixedly connected with a bottom of the first inlet pipe;

the first inlet pipe is inserted into an interior of the cavity through the water block; and the bottom of the first inlet pipe is configured to match with the water outlet in shape, and is connected with the bottom plate through the water outlet;

the fixed plate is boltedly connected to an upper surface of the water block; and an end of an inner side wall of the first inlet pipe close to the fixed plate is provided with the water nozzle; the two first sealing rings are symmetrically sleeved on an outer side wall of the water nozzle; the two first sealing rings are provided on the inner side wall of the first inlet pipe; and the first inlet pipe is configured to pass through the water block through the cavity to be connected to the water nozzle.

In an embodiment, the main body further includes a pump cover, a through hole, a second inlet pipe, and a plurality of fixing bolts; and the pump cover is boltedly connected to the upper surface of the water block.

In an embodiment, the number of the through hole is two; two through holes are provided on a side of the pump cover; an outer side wall of the water block is fixedly connected with the second inlet pipe; and the second inlet pipe is communicated with the cavity through the water block.

In an embodiment, the plurality of fixing bolts are provided on a bottom of the fixed plate.

In an embodiment, a top of the fixed plate is fixedly connected with a pump assembly through the plurality of fixing bolts;

the pump assembly includes a motor, a motor shaft, a pump body, an impeller, a second sealing ring, and an outlet pipe; and the motor shaft is provided at a bottom of the motor.

In an embodiment, an outer side wall of the motor shaft is fixedly connected with the impeller.

In an embodiment, the bottom of the motor is fixedly connected with the pump body, and the pump body is fixedly connected to the top of the fixed plate.

In an embodiment, the bottom of the motor is fixedly connected with the second sealing ring; the second sealing ring is fixedly connected to a top of the pump body; an outer side wall of the pump body is connected with the outlet pipe; the outlet pipe is located on the same side as the second inlet pipe; and the outlet pipe passes through one of the two through holes, and the second inlet pipe passes through the other of the two through holes.

Compared to the prior art, this application has the following beneficial effects.

(1) The integrated water-cooling pump provided herein has simple structure and low production cost. By designing the water block into an integrally-welded structure, the leakage can be avoided. Furthermore, through the arrangement of two water inlets and the outlet, the internal resistance of water flow is reduced, such that the water flow per unit time is increased, thereby achieving better heat dissipation effect.

(2) The pump body is designed in a split-type structure, which makes it convenient for disassembly and maintenance. Meanwhile, the pump is combined with the water block by bolts, and two sets of high-temperature sealing rings are arranged, effectively reducing the risk of water leakage.

The foregoing description is merely illustrative, and is not intended to limit the disclosure. In addition to the aspects, implementations, and features described above, other aspects, implementations, and features of the present disclosure will be easily understood from the following detailed description with reference to the accompanying drawings and embodiments.

BRIEF DESCRIPTION OF THE DRAWINGS

In order to illustrate the embodiments of the present disclosure or the technical solutions in the prior art more clearly, the drawings required in the description of the embodiments or the prior art will be briefly described below. Obviously, presented in the drawings are merely some embodiments of the present disclosure, which are not intended to limit the disclosure. For those skilled in the art, other drawings may also be obtained according to the drawings provided herein without paying creative efforts.

In the figures: 10-main body; 11-water block; 12-pump cover; 13-through hole; 14-second inlet pipe; 15-bottom plate; 16-water inlet; 17-water outlet; 18-cavity; 19-first inlet pipe; 110-fixed plate; 111-water nozzle; 112-first sealing ring; 113-fixing bolt; 20-water pump assembly; 21-motor; 22-motor shaft; 23-pump body; 24-impeller; 25-second sealing ring; and 26-outlet pipe.

DETAILED DESCRIPTION OF EMBODIMENTS

Described below are merely some embodiments, which are not intended to limit the disclosure. It should be understood that various modifications or variations can be made by those skilled in the art without departing from the spirit or scope of the disclosure. The drawings and descriptions are considered illustrative rather than restrictive.

The embodiments of the present disclosure will be described in detail below in conjunction with the accompanying drawings.

Figure 1:
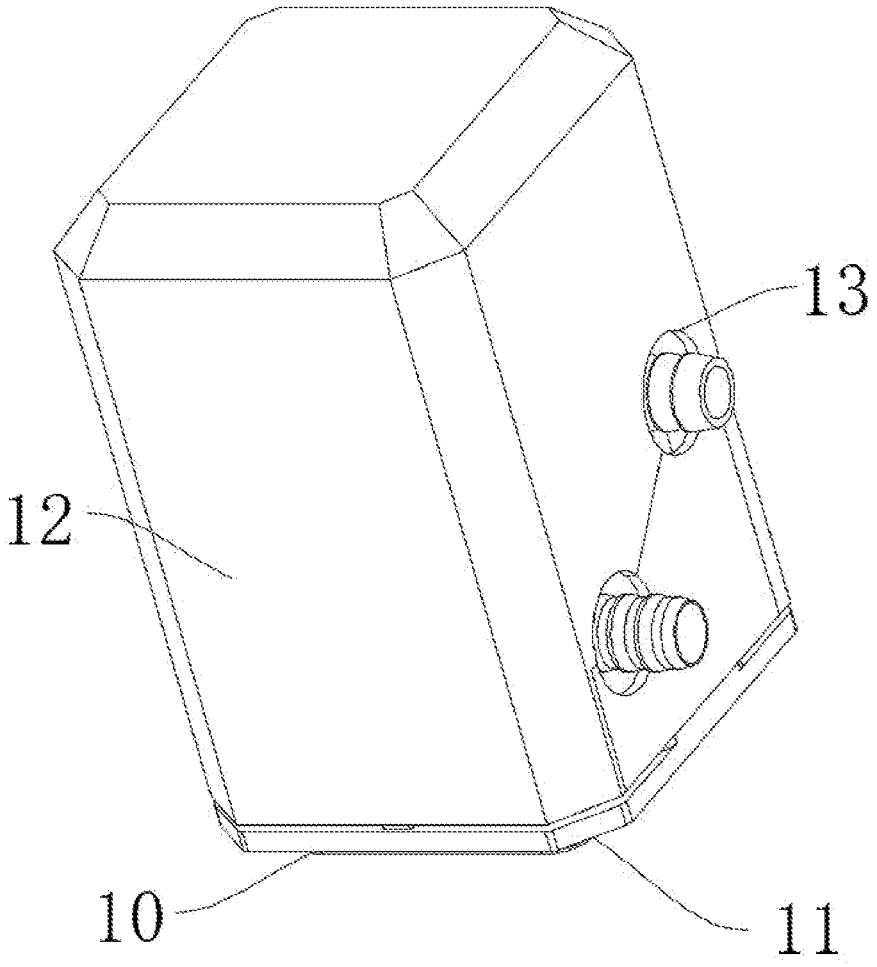
FIG. 1 is a structural diagram of an integrated water-cooling pump according to one embodiment of the present disclosure.
Figure 2:
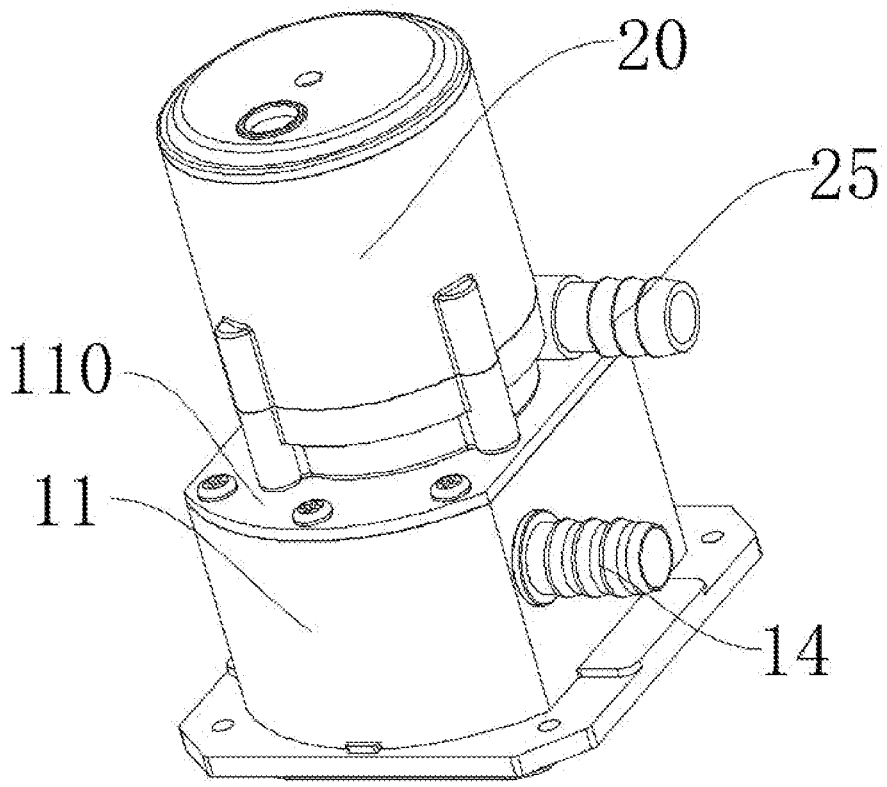
FIG. 2 is a structural diagram of the integrated water-cooling pump according to one embodiment of the present disclosure in the absence of a pump cover.
Figure 3:
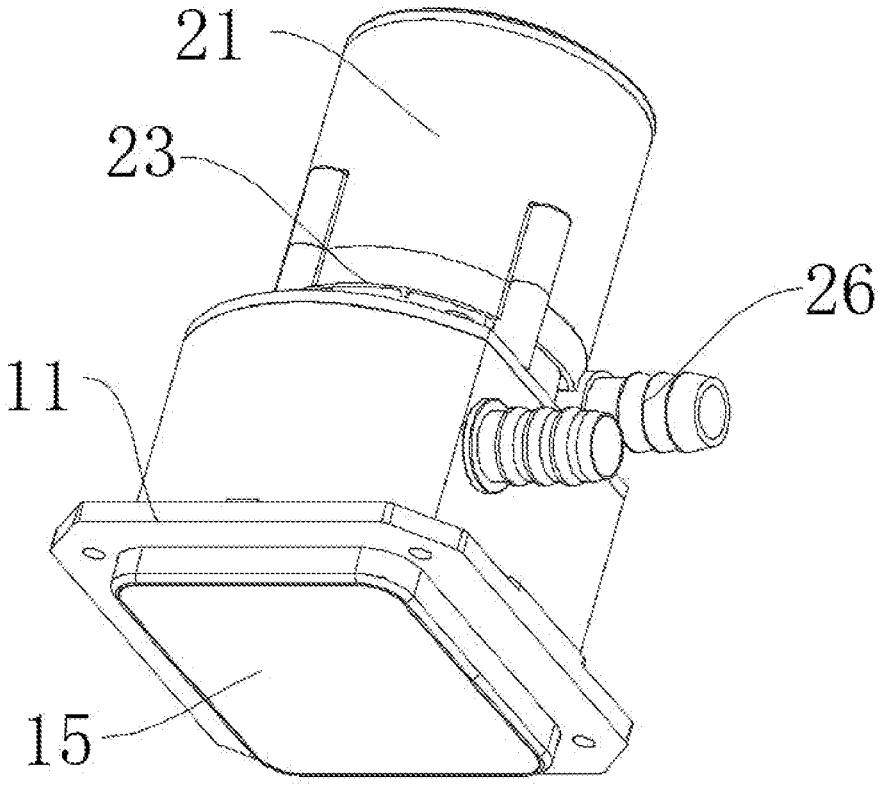
FIG. 3 schematically shows a structure of a bottom plate according to one embodiment of the present disclosure.
Figure 4:
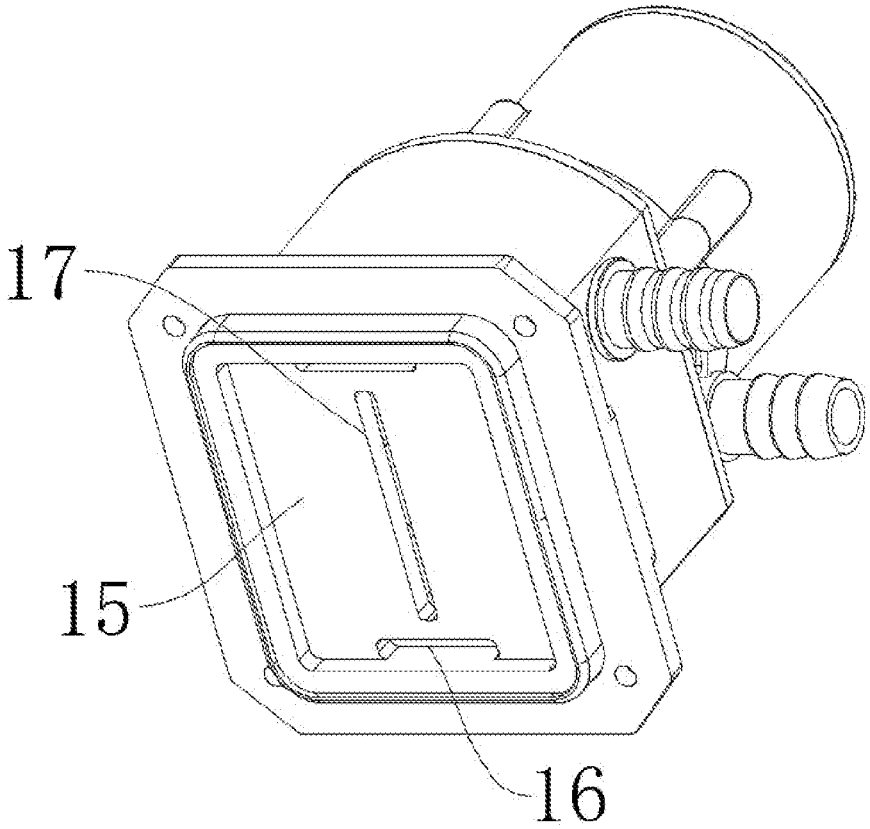
FIG. 4 schematically shows an internal structure of the bottom plate.
Figure 5:
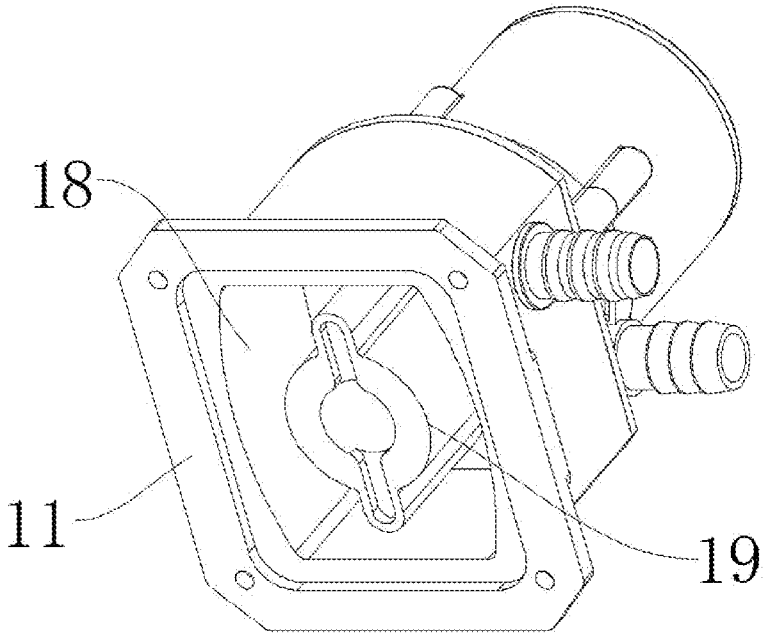
FIG. 5 schematically shows a structure of a first inlet pipe according to one embodiment of the present disclosure.
Figure 6:
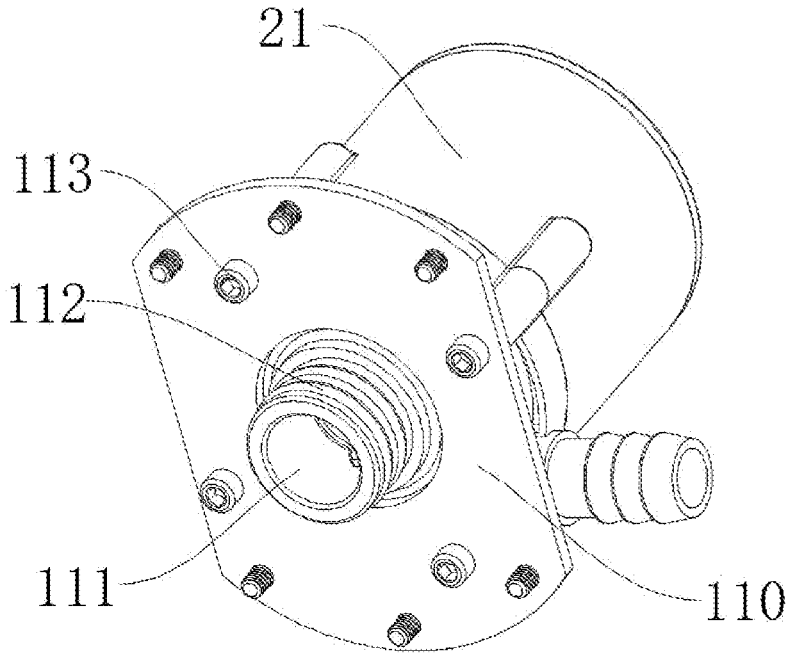
FIG. 6 schematically shows a structure of a water nozzle according to one embodiment of the present disclosure.
Figure 7:
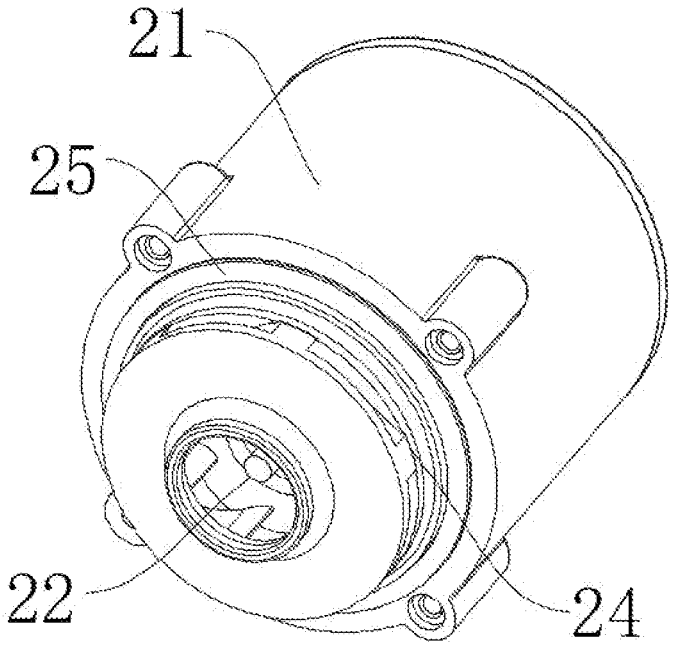
FIG. 7 structurally shows a motor according to one embodiment of the present disclosure.

As shown in FIGS. 1-7, an integrated water-cooling pump is provided herein, which includes a main body 10. The main body 10 includes a water block 11, a bottom plate 15, two water inlets 16, a water outlet 17, a cavity 18, a first inlet pipe 19, a fixed plate 110, a water nozzle 111 and two first sealing rings 112.

The bottom plate 15 is weldedly connected to a bottom of the water block 11. The bottom plate 15 has an internal hollow structure. The bottom of the inner wall of the bottom plate 15 is fixedly connected with heat sinks. The two water inlets 16 are symmetrically provided on two sides of the upper surface of the bottom plate 15. The water outlet 17 is provided at a middle of the upper surface of the bottom plate 15. The cavity 18 is provided at a side in the water block 11 close to the bottom plate 15. The bottom plate 15 is communicated with the cavity 18 through the two water inlets 16. The upper surface of the bottom plate 15 is fixedly connected with the bottom of the first inlet pipe 19. The first inlet pipe 19 is inserted into the inside of the cavity 18 through the water block 11. The bottom of the first inlet pipe 19 is adapted to the shape of the water outlet 17, and connected with the bottom plate 15 through the water outlet 17. The fixed plate 110 is boltedly connected to the upper surface of the water block 11. The end of an inner side wall of the first inlet pipe 19 near the fixed plate 110 is provided with the water nozzle 111. The two first sealing rings 112 are symmetrically sleeved on the outer side wall of the water nozzle 111. The two first sealing rings 112 are provided on the inner side wall of the first inlet pipe 19. The first inlet pipe 19 is configured to pass through the water block 11 through the cavity 18 to be connected to the water nozzle 111.

In this embodiment, the main body 10 further includes a pump cover 12, a through hole 13, a second inlet pipe 14 and a plurality of fixing bolts 113.

The pump cover 12 is connected to the upper surface of the water block 11 by a plurality of bolts. The pump cover 12 is used to protect the internal water-cooling pump from impact damage.

In this embodiment, the number of the through hole 13 is two, and two through holes 13 are provided on a side of the pump cover 12. The outer side wall of the water block 11 is fixedly connected with the second inlet pipe 14. The second inlet pipe 14 is communicated with the cavity 18 through the water block 11, and coolant is fed to the water block 11 through the second inlet pipe 14.

In this embodiment, the plurality of the fixing bolts 113 are provided on the bottom of the fixed plate 110.

In this embodiment, the top of the fixed plate 110 is fixedly connected to a pump assembly 20 through the plurality of fixing bolts 113. The pump assembly 20 includes a motor 21, a motor shaft 22, a pump body 23, a impeller 24, a second seal ring 25, and an outlet pipe 26.

The motor shaft 22 is provided at a bottom of the motor 21, and the impeller 24 rotates by the rotation of the motor shaft 22.

In this embodiment, the outer side wall of the motor shaft 22 is fixedly connected with the impeller 24, and the impeller 24 rotates to drive the circulation flow of the coolant.

In this embodiment, the bottom of the motor 21 is fixedly connected to the pump body 23, and the pump body 23 is fixedly connected to the top of the fixed plate 110. The motor 21 and the pump body 23 are split, which is convenient for the maintenance of the water-cooling pump.

In this embodiment, the bottom of the motor 21 is fixedly connected with the second sealing ring 25. The second sealing ring 25 is fixedly connected to the top of the pump body 23. The outer side wall of the pump body 23 is connected with the outlet pipe 26. The coolant is fed to the radiator for heat dissipation through the outlet pipe 26. The outlet pipe 26 is located on the same side as the second inlet pipe 14, and the outlet pipe 26 passes through one of the two through holes 13. The second inlet pipe 14 passes through the other of the two through holes 13.

The fixed plate 110, the pump body 23, and the motor 21 are fixedly connected by the plurality of fixing bolt 113. The split-type design can facilitate disassembly and maintenance. Then, the fixed plate 110 and the water block 11 are fixed. After finishing connection, the water-cooling pump and the water block 11 form an integrated structure. The water nozzle 111 is located inside the first inlet pipe 19. While the coolant enters the second inlet pipe 14, passes through the cavity 18, the water inlet 16, and the water outlet 17 in turn, and enters the first inlet pipe 19, two first sealing rings 112 can seal the gap between the water-cooling pump and the water block 11, effectively reducing the risk of water leakage. Meanwhile the arrangement of two water inlets 16 and water outlets 17 can reduce the internal resistance of water flow, such that the water flow per unit time is increased, thereby achieving better heat dissipation effect.

Described above are merely preferred embodiments of the disclosure, which are not intended to limit the disclosure. It should be understood that any modifications and replacements made by those skilled in the art without departing from the spirit of the disclosure should fall within the scope of the disclosure defined by the appended claims.

What is claimed is:

1. An integrated water-cooling pump, comprising:

a main body;

wherein the main body comprises a water block, a bottom plate, two water inlets, a water outlet, a cavity, a first inlet pipe, a fixed plate, a water nozzle, and two first sealing rings;

the bottom plate is weldedly connected to a bottom of the water block; the bottom plate has an internal hollow structure; a bottom of an inner wall of the bottom plate is fixedly connected with a heat sink; the two water inlets are symmetrically provided on two sides of an upper surface of the bottom plate; the water outlet is provided at a middle of the upper surface of the bottom plate; the cavity is provided at a side in the water block close to the bottom plate; the bottom plate is communicated with the cavity through the two water inlets; and the upper surface of the bottom plate is fixedly connected with a bottom of the first inlet pipe;

the first inlet pipe is inserted into an interior of the cavity through the water block; and the bottom of the first inlet pipe is configured to match with the water outlet in shape, and is connected with the bottom plate through the water outlet;

the fixed plate is boltedly connected to an upper surface of the water block; and an end of an inner side wall of the first inlet pipe close to the fixed plate is provided with the water nozzle; the two first sealing rings are symmetrically sleeved on an outer side wall of the water nozzle; the two first sealing rings are provided on the inner side wall of the first inlet pipe; and the first inlet pipe is configured to pass through the water block through the cavity to be connected to the water nozzle.

2. The integrated water-cooling pump of claim 1, wherein the main body further comprises a pump cover, a through hole, a second inlet pipe, and a plurality of fixing bolts; and the pump cover is boltedly connected to the upper surface of the water block.

3. The integrated water-cooling pump of claim 2, wherein the number of the through hole is two; two through holes are provided on a side of the pump cover; an outer side wall of the water block is fixedly connected with the second inlet pipe; and the second inlet pipe is communicated with the cavity through the water block.

4. The integrated water-cooling pump of claim 2, wherein the plurality of fixing bolts are provided on a bottom of the fixed plate.

5. The integrated water-cooling pump of claim 4, wherein a top of the fixed plate is fixedly connected with a pump assembly through the plurality of fixing bolts;

the pump assembly comprises a motor, a motor shaft, a pump body, an impeller, a second sealing ring, and an outlet pipe; and the motor shaft is provided at a bottom of the motor.

6. The integrated water-cooling pump of claim 5, wherein an outer side wall of the motor shaft is fixedly connected with the impeller.

7. The integrated water-cooling pump of claim 5, wherein the bottom of the motor is fixedly connected with the pump body, and the pump body is fixedly connected to the top of the fixed plate.

8. The integrated water-cooling pump of claim 7, wherein the bottom of the motor is fixedly connected with the second sealing ring; the second sealing ring is fixedly connected to a top of the pump body; an outer side wall of the pump body is connected with the outlet pipe; the outlet pipe is located on the same side as the second inlet pipe; and the outlet pipe passes through one of the two through holes, and the second inlet pipe passes through the other of the two through holes.

* * * * *